US011041129B2

(12) United States Patent
Smith

(10) Patent No.: US 11,041,129 B2
(45) Date of Patent: Jun. 22, 2021

(54) PROCESSES FOR PRODUCING A FUEL RANGE HYDROCARBON AND A LUBRICANT BASE OIL

(71) Applicant: UOP LLC, Des Plaines, IL (US)

(72) Inventor: Richard J. W. Smith, Wokingham (GB)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 15/685,802

(22) Filed: Aug. 24, 2017

(65) Prior Publication Data

US 2018/0171245 A1 Jun. 21, 2018

Related U.S. Application Data

(60) Provisional application No. 62/436,686, filed on Dec. 20, 2016.

(51) Int. Cl.
*C10G 67/02* (2006.01)

(52) U.S. Cl.
CPC ..... *C10G 67/02* (2013.01); *C10G 2300/202* (2013.01); *C10G 2300/4081* (2013.01); *C10G 2400/10* (2013.01)

(58) Field of Classification Search
CPC ..... C10G 67/0463; C10G 67/049
See application file for complete search history.

(56) References Cited

U.S. PATENT DOCUMENTS

| | | | | |
|---|---|---|---|---|
| 28,398 | A | 5/1860 | Nichols | |
| 3,140,249 | A | 7/1964 | Plank et al. | |
| 3,140,251 | A | 7/1964 | Plank et al. | |
| 3,140,252 | A | 7/1964 | Frilette et al. | |
| 3,140,253 | A | 7/1964 | Plank et al. | |
| 3,700,585 | A | 10/1972 | Chen et al. | |
| 3,852,189 | A | 12/1974 | Chen et al. | |
| 3,956,102 | A | 5/1976 | Chen et al. | |
| 3,968,024 | A | 7/1976 | Gorring et al. | |
| 3,980,550 | A | 9/1976 | Gorring et al. | |
| 4,153,540 | A | 5/1979 | Gorring et al. | |
| 4,176,050 | A | 11/1979 | Chen et al. | |
| 4,222,855 | A | 9/1980 | Pelrine et al. | |
| 4,229,282 | A | 10/1980 | Peters et al. | |
| 4,247,388 | A | 1/1981 | Banta et al. | |
| 4,428,826 | A | 1/1984 | Walsh | |
| 4,440,991 | A | 4/1984 | Sorenson | |
| 4,441,991 | A | 4/1984 | Dwyer et al. | |
| 4,446,007 | A | 5/1984 | Smith | |
| 4,686,029 | A | 8/1987 | Pellet et al. | |
| 5,358,627 | A * | 10/1994 | Mears | C10G 65/12 208/100 |
| 6,569,313 | B1 | 5/2003 | Carroll et al. | |
| 8,834,706 | B2 | 9/2014 | Noh et al. | |
| 2009/0050524 | A1 * | 2/2009 | Kim | C10G 65/12 208/89 |
| 2013/0319910 | A1 | 12/2013 | Koseoglu et al. | |

FOREIGN PATENT DOCUMENTS

| | | | |
|---|---|---|---|
| KR | 2003073026 | | 9/2003 |
| KR | 20030073026 | A * | 9/2003 |

OTHER PUBLICATIONS

Kim (KR-20030073026-A) (English translation).*
Hao, "Production Optimization of Hydro-Upgrading Light Propane Deasphalted Oil to Heavy Lube Base Oil," Petroleum Processing and Petrochemicals, v 40, n 11, p. 61-64, Nov. 2009; ISSN: 10052399; Publisher: Research Institute of Petroleum Processing, SINOPEC.
PCT Search Report dated Dec. 21, 2017 for corresponding PCT Application No. PCT/US2017/055882.

* cited by examiner

*Primary Examiner* — Randy Boyer
(74) *Attorney, Agent, or Firm* — Paschall & Associates, LLC; James C. Paschall

(57) ABSTRACT

Apparatuses and processes for producing at least one lubricant base oil and at least one hydrocarbon fuel range product. A deasphalted oil and a VGO stream and passed to a first hydroprocessing zone. After the first hydroprocessing zone, the hydrocarbon fuel range product may be recovered. After recovering the hydrocarbon fuel range product, the unconverted material may be separated into one or more lubricant base oil streams, and a recycle stream. The lubricant base oil streams may be upgraded, while the recycle stream may be hydroprocessed in a second hydroprocessing zone. The effluents can be combined to allow for efficient separation and recovery of the desired products.

10 Claims, 2 Drawing Sheets

PROCESSES FOR PRODUCING A FUEL RANGE HYDROCARBON AND A LUBRICANT BASE OIL

CROSS-REFERENCE TO RELATED APPLICATION

Figure 1:
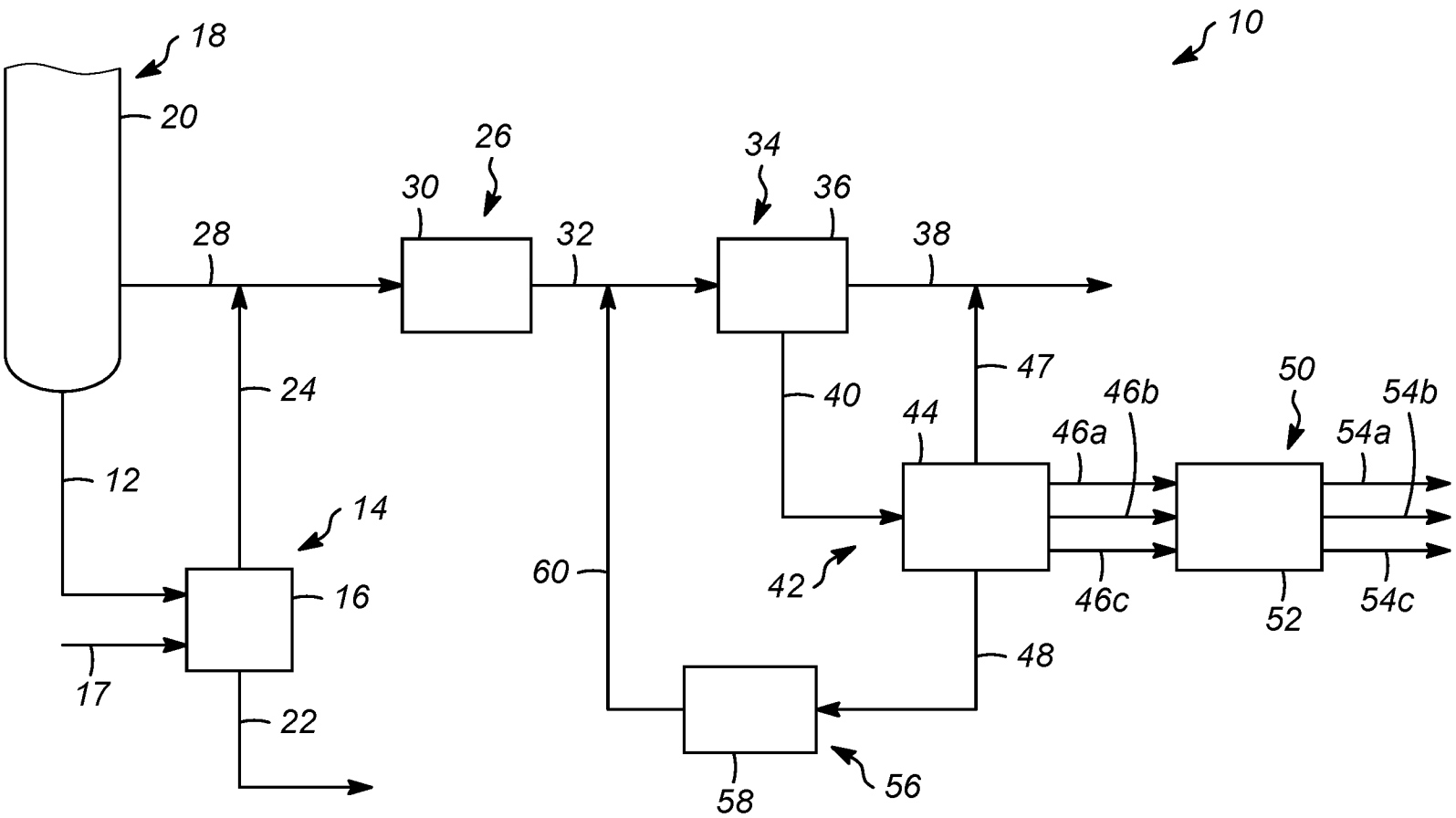

This application claims priority from Provisional Application No. 62/436,686 filed Dec. 20, 2016, the contents of which cited application are hereby incorporated by reference in its entirety.

FIELD OF THE INVENTION

This invention relates generally to producing a fuel range hydrocarbon and a lubricant base oil, and more particularly to processes which obtain the fuel range hydrocarbon and the lubricant base oil from a residue stream from a vacuum distillation zone.

BACKGROUND OF THE INVENTION

As the reserves of conventional crude oils decline, heavy oils must be upgraded to meet demands. In upgrading, the heavier materials are converted to lighter fractions and most of the sulfur, nitrogen and metals must be removed. Crude oil is typically first processed in an atmospheric crude distillation tower to provide fuel range products including naphtha, kerosene and diesel. The atmospheric crude distillation tower bottoms stream is typically taken to a vacuum distillation tower to obtain vacuum gas oil (VGO). The VGO typically boils in a range between at or about 300° C. (572° F.) and at or about 524° C. (975° F.). Additionally, the vacuum distillation tower typically produces a vacuum residue that comprises pitch, oils, and other hydrocarbons that have the potential to be upgraded if they can be efficiently extracted from the pitch in the vacuum residue.

Solvent deasphalting (SDA) permits recovery of heavier hydrocarbons, at relatively low temperatures, without cracking or degradation of heavy hydrocarbons. SDA processes separate hydrocarbons according to their solubility in a liquid solvent, as opposed to volatility in distillation. Lower molecular weight and more paraffinic components are preferentially extracted. The least soluble materials are high molecular weight and most polar aromatic components. Some of these heavier hydrocarbons may be upgraded and recovered as a lubricant base oil.

In some applications, an SDA unit can be utilized to convert a portion of the vacuum residue to more valuable products and thus increase the overall conversion of a refinery. However, if the deasphalted oil from the SDA unit is to be upgraded for lube base oil production, a conflict could arise between the amount of deasphalted oil produced (i.e., the SDA lift), the overall refinery conversion, and the heaviest lube base oil viscosity desired. In these applications, with current processes, the use of an SDA unit for residue upgrading may become infeasible or uneconomic depending on the desired lube viscosity grades and subsequent limit on the deasphalted oil processing.

There is a need for processes that efficiently and effectively utilize SDA in association with recovering heavier hydrocarbons from vacuum residue.

SUMMARY OF THE INVENTION

One or more processes and apparatuses have been invented which efficiently allow for the production of a lubricant base oil and a hydrocarbon fuel range product, for example, a diesel product from a deasphalted oil stream and another hydrocarbon stream. The processes utilize a two stage hydrotreating, with the second stage processing a portion from the unconverted product of the first stage. The second stage effluent is combined with the first stage effluent.

Therefore, in one aspect, the present process may be characterized as a process for the production of a fuel range hydrocarbon and a lubricant base oil stock which comprises: separating a residue stream in a first separation zone into a pitch stream and a deasphalted oil stream with a solvent; hydroprocessing the deasphalted oil stream in a first hydroprocessing zone; hydroprocessing a vacuum gas oil stream in the first hydroprocessing zone; separating an effluent stream from the first hydroprocessing zone in a second separation zone into a fuel range hydrocarbon stream and an unconverted oil stream; separating the unconverted oil stream in a third separation zone into one or more lubricant base oil streams and a recycle stream; hydroprocessing the recycle stream in a second hydroprocessing zone; and, separating an effluent stream from the second hydroprocessing zone in the second separation zone. The process may further comprise upgrading at least a portion of the unconverted oil stream in a dewaxing zone. The dewaxing zone may be disposed downstream of the third separation zone. The dewaxing zone may be disposed upstream of the third separation zone. The process may further comprise combining the deasphalted oil stream and the vacuum gas oil stream. The effluent stream from the second hydroprocessing zone and the effluent stream from the first hydroprocessing zone may be combined. The first separation zone may comprise a solvent deasphalting unit. The second separation zone may comprise a fractionation column. The third separation zone may comprise a vacuum column.

In another aspect, a process is provided for the production of a fuel range hydrocarbon and a lubricant base oil stock by: passing a residue stream from a vacuum distillation zone to a first separation zone configured to separate, with a solvent, the residue stream into a pitch stream and a deasphalted oil stream; passing the deasphalted oil stream to a first hydroprocessing zone containing a catalyst and configured to provide a first effluent stream; passing a vacuum gas oil stream to the first hydroprocessing zone; passing the effluent stream from the first hydroprocessing zone to a second separation zone configured to separate the first effluent stream into a fuel range hydrocarbon stream and an unconverted oil stream; passing the unconverted oil stream to a third separation zone configured to separate the unconverted oil stream into one or more lubricant base oil streams and a recycle stream; passing the recycle stream to a second hydroprocessing zone containing a catalyst and configured to provide a second effluent stream; and, passing the second effluent stream to the second separation zone. The process may further comprise passing a portion of the unconverted oil stream to an upgrading zone configured to dewax the one or more lubricant base oil streams and provide a dewaxed stream. The upgrading zone may receive the one or more lubricant base oil streams. The upgrading zone may receive the unconverted oil stream from the second separation zone. The third separation zone may provide a second fuel range hydrocarbon stream. The process may further comprise combining the vacuum gas oil stream and the deasphalted oil stream to form a combined stream, wherein the first hydroprocessing zone receives the combined stream. The vacuum gas oil stream may be passed to first hydroprocessing zone from the vacuum distillation zone. The first separation zone may comprise a solvent deasphalting unit. The second separation zone may comprise a fractionation column. The first separation zone comprises a vacuum column.

In various aspects, an apparatus for making hydrocarbon fuel and a lubricant base oil stream is provided. The apparatus comprises: a solvent deasphalting unit configured to receive a residue stream from a vacuum distillation zone and provide a pitch stream and a deasphalted oil; a first hydroprocessing zone comprising a reactor with a catalyst and being configured to receive the deasphalted oil and receive a vacuum gas oil, selectively process the deasphalted oil and vacuum gas oil, and to provide a first effluent stream; a fractionation column configured to receive and separate the first effluent stream into a fuel range hydrocarbon stream and an unconverted oil stream; a vacuum column configured to receive and separate the unconverted oil stream into one or more lubricant base oil streams and a recycle stream; a second hydroprocessing zone comprising a reactor with a catalyst and being configured to receive the recycle stream, selectively process the recycle stream, and provide a second effluent stream; and, a recycle line configured to pass the second effluent stream from the second hydroprocessing zone to the fractionation column.

Additional aspects, embodiments, and details of the invention, all of which may be combinable in any manner, are set forth in the following detailed description of the invention.

DEFINITIONS

As used herein, the term "boiling point temperature" means atmospheric equivalent boiling point (AEBP) as calculated from the observed boiling temperature and the distillation pressure, as calculated using the equations furnished in ASTM D1160 appendix A7 entitled "Practice for Converting Observed Vapor Temperatures to Atmospheric Equivalent Temperatures."

As used herein, "pitch" means the hydrocarbon material boiling above about 538° C. (975° F.) AEBP as determined by any standard gas chromatographic simulated distillation method such as ASTM D2887, D6352 or D7169, all of which are used by the petroleum industry.

As used herein, the term "stream" can include various hydrocarbon molecules, such as straight-chain, branched, or cyclic alkanes, alkenes, alkadienes, and alkynes, and optionally other substances, such as gases, e.g., hydrogen, or impurities, such as heavy metals, and sulfur and nitrogen compounds. The stream can also include aromatic and nonaromatic hydrocarbons. Moreover, hydrocarbon molecules may be abbreviated C1, C2, C3 . . . Cn where "n" represents the number of carbon atoms in the one or more hydrocarbon molecules. Furthermore, a superscript "+" or "−" may be used with an abbreviated one or more hydrocarbons notation, e.g., C3+ or C3−, which is inclusive of the abbreviated one or more hydrocarbons. As an example, the abbreviation "C3+" means one or more hydrocarbon molecules of three carbon atoms and/or more. A "stream" may also be or include substances, e.g., fluids, other than hydrocarbons, such as hydrogen.

As used herein, the term "zone" can refer to an area including one or more equipment items and/or one or more sub-zones. Equipment items can include one or more reactors or reactor vessels, heaters, exchangers, pipes, pumps, compressors, and controllers. Additionally, an equipment item, such as a reactor, dryer, or vessel, can further include one or more zones or sub-zones.

As used herein, the term "hydroprocessing" can refer to processing one or more hydrocarbons in the presence of hydrogen, and can include hydrotreating and/or hydrocracking.

As used herein, the term "hydrocracking" can refer to a process breaking or cracking bonds of at least one long-chain hydrocarbon in the presence of hydrogen and at least one catalyst into lower molecular weight hydrocarbons.

As used herein, the term "hydrotreating" can refer to a process including contacting a hydrocarbon feedstock with hydrogen gas in the presence of one or more suitable catalysts for the removal of heteroatoms, such as sulfur, nitrogen and metals from a hydrocarbon feedstock. In hydrotreating, hydrocarbons with double and triple bonds may be saturated, and aromatics may also be saturated, as some hydrotreating processes are specifically designed to saturate aromatics.

As used herein, the term "vacuum distillation" can refer to a process for distilling a stream, typically a bottom stream, from an atmospheric distillation column, by using pressure of less than about 101.3 kPa to facilitate boiling and distillation.

As used herein, the term "vacuum gas oil" can include one or more C22 to C52 hydrocarbons and boil in the range of about 340° to about 590° C. (644° to 1094° F.) or about 340° to about 560° C. (644° to 1040° F.) at about 101.3 kPa (14.7 psi). A vacuum gas oil may be a hydrocarbon product of vacuum distillation and be abbreviated herein as "VGO."

As used herein, the term "diesel" can include hydrocarbons having a boiling point temperature in the range of 150° to 400° C. (302° to 752° F.) and preferably 200° to 400° C. (392° to 752° F.).

As depicted, the process flow lines in the Figures can be referred to interchangeably as, e.g., lines, pipes, feeds, branches, oils, portions, products, or streams.

DETAILED DESCRIPTION OF THE DRAWINGS

Figure 2:
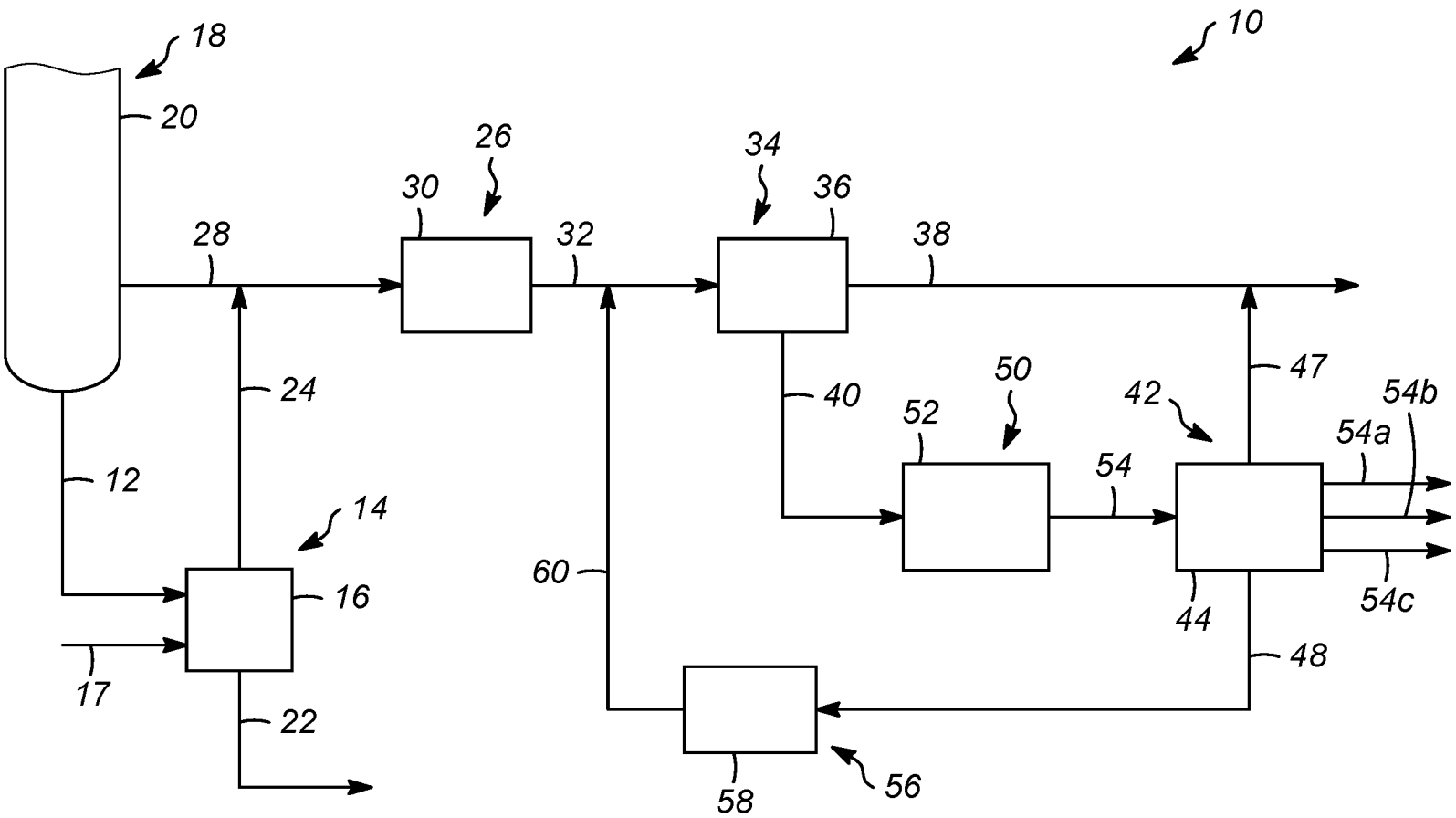

One or more exemplary embodiments of the present invention will be described below in conjunction with the following drawing figures, in which:

FIG. 1 shows a schematic flow diagram of an embodiment of the present an apparatus and a process; and, FIG. 2 shows another schematic flow diagram of an embodiment of the present an apparatus and a process.

DETAILED DESCRIPTION OF THE INVENTION

As mentioned above, apparatuses and processes for producing at lubricant base oil and a hydrocarbon fuel range product have been invented in which a deasphalted oil and a VGO stream and passed to a first hydroprocessing zone. After the first hydroprocessing zone, the hydrocarbon fuel range product may be recovered. After recovering the hydrocarbon fuel range product, the unconverted material may be separated into one or more lubricant base oil streams, and a recycle stream. The lubricant base oil streams may be upgraded, while the recycle stream may be hydroprocessed in a second hydroprocessing zone. The effluents can be combined to allow for efficient separation and recovery of the desired products. Such apparatuses and processes are believed to allow for efficient and effective recovery of the hydrocarbon fuel range product and lubricant base oils stocks, as well as allow a refiner the ability to control production depending on the desirability of the products.

With these general principles in mind, one or more embodiments of the present invention will be described with the understanding that the following description is not intended to be limiting.

As shown in FIGS. 1 and 2, an apparatus is generally designated 10 and may be used for carrying out the various processes. In the processes, a stream 12 is passed to a separation zone 14 comprising a solvent deasphalting unit 16. The stream 12 is preferably a residue stream from a separation zone 18, particularly a vacuum distillation zone, having a vacuum distillation column 20. The residue stream will comprise pitch and hydrocarbons typically having an initial boiling point above 524° C. (975° F.).

The second separation zone 14, and more particularly, the solvent deasphalting unit 16, is configured to receive the stream 12 and separate the components into pitch and deasphalted oil which are contained in streams 22, 24 respectively.

In an exemplary solvent deasphalting unit 16, the residue stream 12 is pumped and admixed with solvent in stream 17, including a recycled solvent and a make-up solvent before entering an extraction column (not shown). Additional solvent may be added to the extraction column. The light paraffinic solvent, typically propane, butane, pentane, hexane, heptane or mixtures thereof dissolves a portion of the pitch in the solvent. The pitch solubilized in the solvent rises to an overhead of the extraction column. The extraction column will typically operate at about 93° to about 204° C. (200° to 400° F.) and about 3.8 to about 5.6 MPa (550 to 850 psi). The temperature and pressure of the extraction column 120 are typically below the critical point of the solvent but can be above or below the critical point as long as the density is well controlled.

The determining quality for solvency of a light hydrocarbon solvent is its density, so equivalent solvents to a particular solvent will have an equivalent density. For example, in an embodiment, heptane is the densest solvent that can be used without lifting high concentrations of vanadium in the deasphalted oil (DAO). Solvents with lower densities than heptane would also be suitable for lifting lower concentrations of vanadium in the DAO. Specifically, the solvent solubilizes the paraffinic and less polar aromatic compounds in the pitch feed. N-pentane is a suitable solvent.

The mixture of solvent and DAO has a lower concentration of metals than in the stream 12. The mixture of solvent and DAO is heated to supercritical temperature for the solvent, for example by indirect heat exchange with heated solvent. The supercritically heated solvent separates from the DAO in a separator column (not shown), in downstream communication with an overhead of the extraction column. The DAO separator column 130 will typically operate at about 177° to about 287° C. (350° to 550° F.) and about 3.8 MPa to about 5.2 MPa (550 to 750 psi). A solvent recycle stream exits the DAO separator column.

A solvent-lean DAO steam exits the separator column and enters a stripper column (not shown) in downstream communication with a bottom of the separator column. The stripper column further separates a solvent from the DAO by stripping DAO from the entrained solvent at low pressure. Steam may be used as stripping fluid in the stripper column. The stripper column 160 will typically operate at about 149° to about 260° C. (300° to 500° F.) and about 344 kPa to about 1,034 kPa (50 to 150 psi). Another solvent recovery stream may be recovered from the stripper column. Additionally, the solvent-free, deasphalted oil stream 24 is provided from the stripper column.

The heavier portions of the residue stream 12 are insoluble and settle down in the extraction column. A bottoms stream from the extractor contains a greater concentration of metals than in the feed in the residue stream 12. The bottoms stream is heated, for example, by a fired heater or by other means of heat exchange, and stripped in a pitch stripper column (not shown) to yield a solvent-lean pitch stream and a solvent recovery stream. Steam may be used as stripping fluid in the pitch stripper column. The pitch stripper column is in downstream communication from said solvent extraction column for separating solvent from pitch. The pitch stripper will typically operate at about 204° to about 260° C. (400° to 500° F.) and about 344 kPa to about 1,034 kPa (50 to 150 psi). The solvent-lean pitch stream comprises the pitch stream 22. The further processing of the pitch stream 22 is not necessary for the understanding or practicing of the present invention.

The deasphalted oil stream 24, is passed to a first hydroprocessing zone 26. Additionally, another hydrocarbon stream 28, for example a VGO stream. is passed to the first hydroprocessing zone 26. As indicated above, if the separation zone 18 that provides the residue stream 12 comprises the vacuum distillation column 20, it is contemplated that the VGO stream 28 is also from the vacuum distillation column 20. The VGO stream 28 and the deasphalted oil stream 24 may be combined and then passed into the first hydroprocessing zone 26 as a combined stream, or the VGO stream 28 and the deasphalted oil stream 24 may be passed as separated streams. Other streams are contemplated as being suitable as the other hydrocarbon stream 28 in the present processes, including, for example, an unconverted oil stream having hydrocarbons heavier than diesel, or a mixture of VGO and distillate streams.

Returning to FIGS. 1 and 2, the first hydroprocessing zone 26 includes a hydroprocessing reactor 30 containing a hydroprocessing catalyst and being operated conditions to selectively hydroprocess the VGO stream 28 and the deasphalted oil stream 24 and provide an effluent stream 32. A hydrogen containing gas stream (not shown) is typically passed into the hydroprocessing reactor 30.

The hydroprocessing can include at least one of hydrotreating and hydrocracking. As is known, hydrotreating comprises utilization of a catalyst and appropriate conditions such that the organic sulfur compounds from the hydrocarbons are removed and converted into hydrogen sulfide ($H_2S$) and the organic nitrogen compounds are removed and converted into ammonia ($NH_3$). Additionally, known in the art, hydrocracking comprises utilization of a suitable hydrocracking catalyst, such as an acidic hydrocracking catalyst, and suitable conditions to break the larger hydrocarbon molecules into smaller, more desirable hydrocarbons.

Hydrotreating catalysts and conditions are known to one skilled in the art. Exemplary hydrotreating catalysts comprise Group VIII metals such as nickel and/or cobalt and Group VI metals such as molybdenum and/or tungsten on a high surface area support such as alumina. The Group VIII metal typically comprises about 2 to about 20 wt % and the Group VI metal typically comprises about 1 to about 25 wt %.

Exemplary hydrotreating conditions comprise a temperature of about 260° to about 454° C. (500° to 892° F.), a hydrogen partial pressure of about 2,000 to about 14,000 kPa (approximately 290 to 2031 psi) (typically about 4,000 to about 7,000 kPa (approximately 580 to 1015 psi)), and a liquid hourly space velocity (LHSV) of about 0.5 to about 10 $hr^{-1}$ (typically about 1 $hr^{-1}$ to about 3 $hr^{-1}$).

As is known, a hydrocracking catalyst comprising a hydrogenation component, for example a Group VIII metal component and/or a Group VIB metal component, generally dispersed on a support. More specifically, the hydrocracking catalyst typically contains between 5 and 50 wt % of a Group VIB metal component, measured as the trioxide, and/or between 2 and 20 wt % of a Group VIII metal component, measured as the monoxide, supported on a suitable refractory oxide. In order to provide an acidic base for the hydrocracking catalyst, the support may be an amorphous silica-alumina or zeolite. Other refractory oxides may also be utilized. The catalyst can be produced by conventional methods including impregnating a preformed catalyst support. Other methods include co-gelling, co-mulling or precipitating the catalytic metals with the catalyst support followed by calcination. Preferred catalysts contain amorphous oxide supports which are extruded and subsequently impregnated with catalytic metals.

Exemplary hydrocracking conditions include a temperature from about 232° to about 427° C. (450° to 800° F.), a pressure from about 3.5 to about 17.2 MPa (500 to 2,500 psig), and a liquid hourly space velocity from about 0.5 to about 5 $hr^{-1}$.

The first effluent stream 32 from the first hydroprocessing zone 26 is passed to another separation zone 34, preferably comprising a fractionation column 36. The fractionation column 36 is configured to separate the components of the first effluent stream 32, as is known in the art, and provide at least one fuel range hydrocarbon stream 38 and an unconverted oil stream 40.

It is contemplated that the fuel range hydrocarbon stream 38 comprises a diesel fuel. However, other fuel range hydrocarbons streams are contemplated including, for example, a jet fuel, kerosene and gasoline or naphtha streams. The boiling point ranges of the various product fractions recovered in any particular refinery will vary with such factors as the characteristics of the crude oil source, the refinery's local markets, product prices, etc. Reference is made to ASTM standards D-975 and D-3699-83 for further details on kerosene and diesel fuel properties and to D-1655 for aviation turbine feed.

As depicted in FIG. 1, the unconverted oil stream 40 may be passed to another separation zone 42, which preferably comprises a vacuum column 44. The vacuum column 44 utilizes vacuum distillation and is configured to separate the components of the unconverted oil stream 40 into one or more lubricant base oil steams 46*a*, 46*b*, 46*c*, and a recycle stream 48, discussed below. The number and components of the lubricant base oil steams 46*a*, 46*b*, 46*c* can be based upon desirability with viscosity being a determining factor for the separation of same. The vacuum column 44 of the separation zone 42 may also provide a second fuel range hydrocarbon stream 47 which is similar in composition to the at least one fuel range hydrocarbon stream 38 from the separation zone 34 with the fractionation column 36.

The lubricant base oil streams 46*a*, 46*b*, 46*c* may be passed to an upgrading zone 50 comprising, for example, a dewaxing unit 52. In the dewaxing unit 52, one or more packed beds or trays include a catalyst that improves at least one cold flow property (i.e., pour point, cloud point, etc.) of the hydrocarbons. Dewaxing and hydro-dewaxing processes are employed in the refining industry to treat petroleum fractions having initial boiling points over about 177° C. (350° F.) to improve at least one cold flow property. The improvement in pour point is generally effected by selective removal of normal paraffins or hydroisomerization of normal paraffins.

Processes relating to dewaxing and hydroisomerization are well known in both the patent and scientific literature. Such processes have employed crystalline aluminosilicates as catalysts. For example, see U.S. Pat. Nos. 3,140,249; 3,140,252; 3,140,251; 3,140,253; 3,956,102; and 4,440,991. Further, ZSM type aluminosilicates have been disclosed for use in hydrocarbon conversion processes involving dewaxing. Representative patents include U.S. Pat. Nos. Re. 28,398; 3,700,585; 3,852,189; 3,980,550, 3,968,024; 4,247,388; 4,153,540; 4,229,282; 4,176,050; 4,222,855; 4,428,826; 4,446,007; 4,686,029. These and other patents disclose the use of various crystalline aluminosilicates as catalysts for dewaxing processes. Additionally, disclosure of a catalyst containing a crystalline silicate, as opposed to a crystalline aluminosilicate, is disclosed in U.S. Pat. No. 4,441,991.

The dewaxing catalyst may be a hydro-dewaxing catalyst comprising a hydrogenating component on a support containing a dispersion of an intermediate pore molecular sieve in a porous refractory oxide. Examples of such preferred catalysts typically comprise between 5 and 50 wt % of a Group VIB metal component and/or from about 2 to about 20 wt % of a Group VIII metal component together with a dewaxing component on a suitable refractory oxide. Preferred Group VIII metals include nickel and cobalt, and preferred Group VIB metals include molybdenum and tungsten. One of the most preferred hydrogenation component combinations is nickel-tungsten. Suitable refractory oxides include silica, silica-alumina, silica-magnesia, silica-titania and the like with alumina being preferred. The catalyst preferably comprises an intermediate pore crystalline molecular sieve having cracking activity, such as silicalite or an aluminosilicate having a high ratio of silica. Preferred catalysts include a support comprising the intermediate pore molecular sieve dispersed in an alumina matrix. Such supports can be produced, for example, by extruding a mixture of a 30 wt % molecular sieve dispersion in 70 wt % alumina. The alumina used in the support is a mixture preferably containing from about 50 to about 75 wt % gamma alumina and from about 25 to about 50 wt % peptized Catapal alumina. One preferred catalyst comprises about 4% wt nickel (measured as NiO) and about 22 wt % tungsten (measured as $WO_3$) on a support comprising about 30 wt % of silicalite dispersed in about 70 wt % of the alumina mixture. An alternative preferred catalyst comprises a support of about 80% wt silicalite dispersed in 20 wt % of the alumina mixture. Another alternative preferred catalyst is a hydroisomerization type catalyst containing noble metal.

In general, the dewaxing catalyst may comprise a catalyst with a pore opening sufficient to reduce a pour point, a cloud point, a cold filter plug point of a diesel stream, for example, a silicalite catalyst, a ZSM-5 catalyst, a beta zeolite catalyst, a catalyst with a Group VIII metal on a bound zeolite, MIDW, a catalyst comprising metal supported on amorphous aluminosilicate or zeolite beta (beta), normally possess large pores that allow the formation of branch structures during paraffin isomerization. Examples of other large pore molecular sieves include ZSM-3, ZSM-12, ZSM-20, MCM-37, MCM-68, ECR-5, SAPO-5, SAPO-37. Any number of suitable catalyst may be used and the present invention is not intended to be bound to any particular catalyst.

The operating conditions of the dewaxing unit 52 preferably include pressures between about 3.5 to 17.2 MPag (500 to 2,500 psig) and temperatures between about 343° to 427° C. (650° to 800° F.).

Alternatively, with reference to FIG. 2, the entirety of the unconverted oil stream 40 may be passed to the dewaxing unit 52 of the upgrading zone 50. An upgraded effluent stream 54 may be passed to and separated in the vacuum column 44 of the separation zone 42 into the lubricant base oil streams 54*a*, 54*b*, 54*c* and the recycle stream 48. Again, the separation zone 42 with the vacuum column 44 may provide the second fuel range hydrocarbon stream 47 which is similar in composition to the at least one fuel range hydrocarbon stream 38 from the separation zone 34 with the fractionation column 36.

In the embodiment of FIG. 1, the dewaxing unit 52 would most likely operate in a batch mode-processing the various lubricant base oil streams 54*a*, 54*b*, 54*c* individually. In contrast, in the embodiment of FIG. 2, the dewaxing unit 52 could be operated to continually process the unconverted oil stream 40. However, since the dewaxing unit 52 is processing the entirety of the unconverted oil stream 40, it is believed that the dewaxing unit 52 will need to be larger in the configuration of FIG. 2 compared with the configuration of FIG. 1.

In both embodiments, the recycle stream 48 from the separation zone 42 with the vacuum column 44 is passed to a second hydroprocessing zone 56. The second hydroprocessing zone 56 also comprises a reactor 58 and includes a catalyst which, under the proper processing conditions, is configured to hydrotreat and hydrocrack the hydrocarbons in the recycle stream 48 to provide a second effluent stream 60. The second hydroprocessing zone 56 may also receive a hydrogen containing gas and be operated under similar or different conditions as the first hydroprocessing zone 26; however, it is contemplated that the second hydroprocessing zone 56 is operated under more severe conditions. The second effluent 60 is passed back to the separation zone 34 with the fractionation column 36 to allow for separation of hydrocarbons as discussed above with respect to the first effluent stream 32 from the first hydroprocessing zone 26.

As discussed above, such processes and apparatuses efficiently allow for the effect and effective production of a hydrocarbon fuel and a lubricant base stock from an SDA unit processing a vacuum residence bottoms stream that includes pitch.

Accordingly, it is further contemplated that the separation in the separation zone 42 with the vacuum column 42 separating the unconverted oil stream 40 zone is controlled such that the cuts, which can be based upon, for example, the viscosity of the product, are based upon the desired end product(s). Thus, the processes may be dynamic allowing for an operator to make adjusts to the process condition based upon the desirability of the products. Accordingly, when the transportation fuel range hydrocarbons are more desired, the conditions of the reaction and separation zones can be adjusted to focus production on the transportation fuel range hydrocarbons products.

It should be appreciated and understood by those of ordinary skill in the art that various other components such as valves, pumps, filters, coolers, etc. were not shown in the drawings as it is believed that the specifics of same are well within the knowledge of those of ordinary skill in the art and a description of same is not necessary for practicing or understanding the embodiments of the present invention.

SPECIFIC EMBODIMENTS

While the following is described in conjunction with specific embodiments, it will be understood that this description is intended to illustrate and not limit the scope of the preceding description and the appended claims.

A first embodiment of the invention is a process for the production of a fuel range hydrocarbon and a lubricant base oil stock comprising separating a residue stream in a first separation zone into a pitch stream and a deasphalted oil stream with a solvent; hydroprocessing the deasphalted oil stream in a first hydroprocessing zone; hydroprocessing a vacuum gas oil stream in the first hydroprocessing zone; separating an effluent stream from the first hydroprocessing zone in a second separation zone into a fuel range hydrocarbon stream and an unconverted oil stream; separating the unconverted oil stream in a third separation zone into one or more lubricant base oil streams and a recycle stream; hydroprocessing the recycle stream in a second hydroprocessing zone; and, separating an effluent stream from the second hydroprocessing zone in the second separation zone. An embodiment of the invention is one, any or all of prior embodiments in this paragraph up through the first embodiment in this paragraph further comprising upgrading at least a portion of the unconverted oil stream in a dewaxing zone. An embodiment of the invention is one, any or all of prior embodiments in this paragraph up through the first embodiment in this paragraph wherein the dewaxing zone is disposed downstream of the third separation zone. An embodiment of the invention is one, any or all of prior embodiments in this paragraph up through the first embodiment in this paragraph wherein the dewaxing zone is disposed upstream of the third separation zone. An embodiment of the invention is one, any or all of prior embodiments in this paragraph up through the first embodiment in this paragraph further comprising combining the deasphalted oil stream and the vacuum gas oil stream. An embodiment of the invention is one, any or all of prior embodiments in this paragraph up through the first embodiment in this paragraph further comprising combining the effluent stream from the second hydroprocessing zone and the effluent stream from the first hydroprocessing zone. An embodiment of the invention is one, any or all of prior embodiments in this paragraph up through the first embodiment in this paragraph wherein the first separation zone comprises a solvent deasphalting unit. An embodiment of the invention is one, any or all of prior embodiments in this paragraph up through the first embodiment in this paragraph wherein the second separation zone comprises a fractionation column. An embodiment of the invention is one, any or all of prior embodiments in this paragraph up through the first embodiment in this paragraph wherein the third separation zone comprises a vacuum column.

A second embodiment of the invention is a process for the production of a fuel range hydrocarbon and a lubricant base oil stock comprising passing a residue stream from a vacuum distillation zone to a first separation zone configured to separate, with a solvent, the residue stream into a pitch stream and a deasphalted oil stream; passing the deasphalted oil stream to a first hydroprocessing zone containing a catalyst and configured to provide a first effluent stream; passing a vacuum gas oil stream to the first hydroprocessing zone; passing the first effluent stream from the first hydroprocessing zone to a second separation zone configured to separate the first effluent stream into a fuel range hydrocarbon stream and an unconverted oil stream; passing the unconverted oil stream to a third separation zone configured to separate the unconverted oil stream into one or more lubricant base oil streams and a recycle stream; passing the recycle stream to a second hydroprocessing zone containing a catalyst and configured to provide a second effluent stream; and, passing the second effluent stream to the second separation zone. An embodiment of the invention is one, any or all of prior embodiments in this paragraph up through the second embodiment in this paragraph further comprising passing a portion of the unconverted oil stream to an upgrading zone configured to dewax the one or more lubricant base oil streams and provide a dewaxed stream. An embodiment of the invention is one, any or all of prior embodiments in this paragraph up through the second embodiment in this paragraph wherein the upgrading zone receives the one or more lubricant base oil streams. An embodiment of the invention is one, any or all of prior embodiments in this paragraph up through the second embodiment in this paragraph wherein the upgrading zone receives the unconverted oil stream from the second separation zone. An embodiment of the invention is one, any or all of prior embodiments in this paragraph up through the second embodiment in this paragraph wherein the third separation zone provides a second fuel range hydrocarbon stream. An embodiment of the invention is one, any or all of prior embodiments in this paragraph up through the second embodiment in this paragraph further comprising combining the vacuum gas oil stream and the deasphalted oil stream to form a combined stream, wherein the first hydroprocessing zone receives the combined stream. An embodiment of the invention is one, any or all of prior embodiments in this paragraph up through the second embodiment in this paragraph wherein the vacuum gas oil stream is passed to the first hydroprocessing zone from the vacuum distillation zone. An embodiment of the invention is one, any or all of prior embodiments in this paragraph up through the second embodiment in this paragraph wherein the first separation zone comprises a solvent deasphalting unit. An embodiment of the invention is one, any or all of prior embodiments in this paragraph up through the second embodiment in this paragraph wherein the second separation zone comprises a fractionation column. An embodiment of the invention is one, any or all of prior embodiments in this paragraph up through the second embodiment in this paragraph wherein the first separation zone comprises a vacuum column.

A third embodiment of the invention is an apparatus for making hydrocarbon fuel and a lubricant base oil stream comprising a solvent deasphalting unit configured to receive a residue stream from a vacuum distillation zone and provide a pitch stream and a deasphalted oil; a first hydroprocessing zone comprising a reactor with a catalyst and being configured to receive the deasphalted oil and receive a vacuum gas oil, selectively process the deasphalted oil and vacuum gas oil, and to provide a first effluent stream; a fractionation column configured to receive and separate the first effluent stream into a fuel range hydrocarbon stream and an unconverted oil stream; a vacuum column configured to receive and separate the unconverted oil stream into one or more lubricant base oil streams and a recycle stream; a second hydroprocessing zone comprising a reactor with a catalyst and being configured to receive the recycle stream, selectively process the recycle stream, and provide a second effluent stream; and, a line configured to pass the second effluent stream from the second hydroprocessing zone to the fractionation column.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

The invention claimed is:

1. A process for the production of a fuel range hydrocarbon and a lubricant base oil stock comprising:

passing a residue stream from a vacuum distillation zone to a first separation zone configured to separate, with a solvent, the residue stream into a pitch stream and a deasphalted oil stream;

passing the deasphalted oil stream to a first hydroprocessing zone containing a catalyst and configured to provide a first effluent stream;

passing a vacuum gas oil stream to the first hydroprocessing zone;

passing the first effluent stream from the first hydroprocessing zone to a second separation zone configured to separate the first effluent stream into a fuel range hydrocarbon stream and an unconverted oil stream;

passing the unconverted oil stream to a third separation zone configured to separate the unconverted oil stream into one or more lubricant base oil streams, a second fuel range hydrocarbon stream and a recycle stream, wherein the second fuel range hydrocarbon stream is taken from an overhead of the third separation zone;

passing the recycle stream to a second hydroprocessing zone containing a catalyst and configured to provide a second effluent stream; and, passing the second effluent stream to the second separation zone.

2. The process of claim 1 further comprising:

passing a portion of the unconverted oil stream to an upgrading zone configured to dewax the one or more lubricant base oil streams and provide a dewaxed stream.

3. The process of claim 2 wherein the upgrading zone receives the one or more lubricant base oil streams.

4. The process of claim 2 wherein the upgrading zone receives the unconverted oil stream from the second separation zone.

5. The process of claim 1 wherein the third separation zone provides a second fuel range hydrocarbon stream.

6. The process of claim 1 further comprising:

combining the vacuum gas oil stream and the deasphalted oil stream to form a combined stream, wherein the first hydroprocessing zone receives the combined stream.

7. The process of claim 1 wherein the vacuum gas oil stream is passed to the first hydroprocessing zone from the vacuum distillation zone.

8. The process of claim 1 wherein the first separation zone comprises a solvent deasphalting unit.

9. The process of claim 8 wherein the second separation zone comprises a fractionation column.

10. The process of claim 9 wherein the first separation zone comprises a vacuum column.

* * * * *